US005294056A

United States Patent [19]

Buchholz et al.

[11] Patent Number: 5,294,056

[45] Date of Patent: Mar. 15, 1994

[54] FUEL-GAS MIXTURE INJECTOR WITH A DOWNSTREAM MIXING CONDUIT

[75] Inventors: Juergen Buchholz, Lauffen; Martin Maier, Moeglingen, both of Fed. Rep. of Germany

[73] Assignee: Robert Bosch GmbH, Stuttgart, Fed. Rep. of Germany

[21] Appl. No.: 935,710

[22] Filed: Aug. 27, 1992

[30] Foreign Application Priority Data

Sep. 12, 1991 [DE] Fed. Rep. of Germany ..... 4130351

[51] Int. Cl.[5] ..... F02M 61/18

[52] U.S. Cl. ..... 239/408; 239/427; 239/533.12; 239/585.1

[58] Field of Search ..... 239/408, 533.12, 585.1, 239/585.4, 585.5, DIG. 23, 427; 123/531

[56] References Cited

U.S. PATENT DOCUMENTS

| | | | |
|---|---|---|---|
| 1,697,334 | 1/1929 | Vitte | 239/427 |
| 2,012,139 | 8/1935 | Peabody | 329/427 |
| 2,201,080 | 5/1940 | Clark | 239/427 X |
| 2,583,726 | 1/1952 | Chalom | 239/427 X |
| 3,782,639 | 1/1974 | Boltz et al. | 239/533.12 X |
| 4,566,634 | 1/1986 | Wiegand | 239/533.12 X |
| 5,035,358 | 7/1991 | Katsuno et al. | 239/585.1 X |

FOREIGN PATENT DOCUMENTS 3609798 10/1986 Fed. Rep. of Germany .

*Primary Examiner*—Andres Kashnikow
*Assistant Examiner*—William Grant
*Attorney, Agent, or Firm*—Edwin E. Greigg; Ronald E. Greigg

[57] ABSTRACT

A fuel injection valve for injecting a fuel-gas mixture into a mixture-compressing internal combustion engine with externally supplied ignition comprising a mixing conduit secured to one end of the fuel injection valve. The mixing conduit includes at least one cross-sectional constriction and an adjoining widening of the cross-section, through which the fuel-gas mixture flows at increased speed which tears off the fuel film from the wall of the mixing conduit and atomizes it into fine fuel droplets. In this way, the quality of fuel atomization can be substantially improved.

11 Claims, 3 Drawing Sheets

FUEL-GAS MIXTURE INJECTOR WITH A DOWNSTREAM MIXING CONDUIT

BACKGROUND OF THE INVENTION

The invention is based on an apparatus for injecting a fuel-gas mixture defined hereinafter. From German Patent Document 36 09 798 A1, an apparatus for injecting a fuel-gas mixture is already known in which the fuel is fed through a fuel injection valve into a first end of a cylindrical mixing conduit of a mixing tube. The gas is blown through a gas delivery conduit that discharges into the first conduit end and strikes the injected fuel. This produces a two-phase flow or in other words a fuel-gas mixture made up of the fuel and the gas. However, this apparatus has the disadvantage that a considerable portion of the fuel settles on the cylindrical wall of the mixing conduit n the form of a fuel film, which is only partly entrained by the fuel-gas mixture flowing past it and runs along the wall of the mixing conduit, so that the fluid-gas mixture contains only a relatively small proportion of liquid fuel. The fuel is inadequately atomized, and a largely homogeneous mixture formation is not assured. Moreover, the danger exists that for a certain injection quantity, the fuel that has collected on the cylindrical wall of the mixing conduit may suddenly tear away and form an undesirable fuel-gas mixture that is only inadequately atomized when it reaches the intake tube.

OBJECT AND SUMMARY OF THE INVENTION

The apparatus according to the invention has an advantage over the prior art that the formation of a fuel film on the wall of the mixing conduit is substantially lessened. Because of an increased speed of the fuel-gas mixture in the cross-sectional constrictions of the mixing conduit and the ensuing cross-sectional expansions, the fuel film is torn from the wall of the mixing conduit and breaks down into fine fuel droplets. In this way, particularly good atomization of the fuel and the formation of a maximally homogeneous fuel-gas mixture are attained even with relatively small delivered gas quantities.

For effectively lessening the fuel film over the entire circumference and length of the wall of the mixing conduit, it is especially advantageous if at least two adjacent cross-sectional constrictions have elongated free opening cross sections, and if the elongated free opening cross sections each have a longitudinal axis in the direction of the greatest length of the applicable free opening cross section, and the longitudinal axes of the free opening cross sections of two adjacent cross-sectional constrictions extend at right angles to one another.

It is advantageous if a throttle restriction is provided in a second end of the mixing conduit remote from the first end. The throttle restriction causes tearing away and preatomization of the fuel film at the second end of the mixing conduit, so that the proportion of liquid fuel in the fuel-gas mixture is increased and the atomization is improved.

To achieve a single- or multiple-stream characteristic of the injected fuel-gas mixture with various stream angles and stream plane angles, it is advantageous if a nozzle cap that has at least one nozzle opening is provided on the second end of the mixing conduit.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
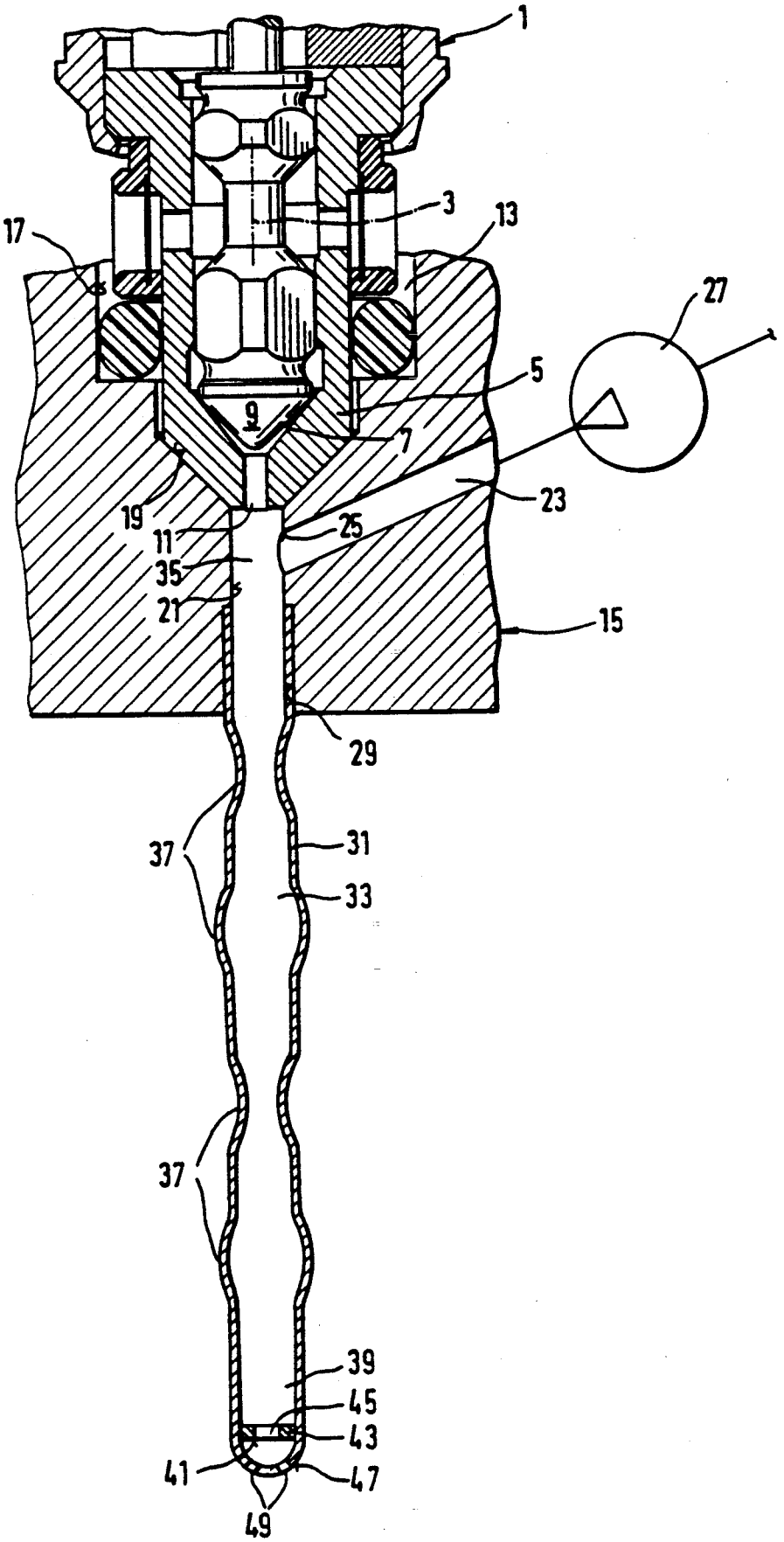
FIG. 1 shows a first exemplary embodiment of an apparatus according to the invention, with a fuel injection valve shown in fragmentary form.

The apparatus, shown by way of example and in fragmentary form in FIG. 1, for injecting a fuel-gas mixture into an intake tube, or directly into a mixture-compressing internal combustion engine with externally supplied ignition, has a fuel injection valve 1 with a valve end 5 that tapers frustoconically, for example concentrically with a longitudinal valve axis 3. The fuel injection valve 1 has a valve closing body 9 that cooperates with a fixed valve seat 7 and is for example electromagnetically actuatable in a known manner. Downstream of the valve seat 7, the valve end 5 of the fuel injection valve 1 has one injection port 11 concentric with a longitudinal valve axis 3, by way of example, but more than one injection port may also be provided.

The fuel injection valve 1 protrudes by its end 5 into a stepped receiving bore 13 of a gas enveloping part 15 the bore extends concentrically with the longitudinal valve axis 3. The stepped receiving bore 13 has a first cylindrical portion 17, which partly surrounds the fuel injection valve 1, and a frustoconically tapering bearing portion 19 on which the frustoconically tapering end 5 of the fuel injection valve 1 rests. The frustoconical circumference of the valve end 5 and the bearing portion 19 of the stepped receiving bore 13 extend parallel to one another. Embodying the valve end 5 and the bearing portion 19 of the stepped receiving bore 13 conically produces simple yet very exact centering of the valve end 5 of the fuel injection valve 1 in the receiving bore 13 of the gas enveloping part 15.

In the fuel flow direction, the frustoconically tapering bearing portion 19 is adjoined by a second, cylindrical portion 21, into which the fuel injected through the injection port 11 of the fuel injection valve 1 is injected. A single gas delivery conduit 23, for example, which serves to deliver the gas and discharges into the second cylindrical portion 21 of the receiving bore 13 at a conduit opening 25 in the fuel injection direction, inclined obliquely relative to the longitudinal valve axis 3, is embodied in the gas enveloping part 15. However, it is also possible for two or more gas delivery conduits 23 to be embodied in the gas enveloping part 15.

Either air diverted from the engine intake tube or the engine exhaust gas may for example be used as the gas to form the fuel-gas mixture. The gas is fed into the gas enveloping part 15 by means of a pump 27, for example.

The second, cylindrical portion 21 is adjoined in the mixture flow direction by a third, cylindrical portion 29, which extends as far as the downstream end of the stepped receiving bore 13 of the gas enveloping part 15 and has a larger diameter than the second, cylindrical portion 21. Protruding into the third, cylindrical portion 29 is a mixing tube 31, which remote from the fuel injection valve 1 extends in the mixture flow direction, concentric with the longitudinal valve axis 3. The mixing tube 31 is retained in the stepped receiving bore 13 by a press-fit, for example, in the region of the third, cylindrical portion 29, and it protrudes past the gas enveloping part 15 in the mixture flow direction. Together with the second, cylindrical portion 21 of the stepped receiving bore 13, the mixing tube 31 forms a mixing conduit 33 in its interior; the fuel is fed through the fuel injection valve 1 into the first end 35 of this conduit, formed by the second, cylindrical portion 21, and the gas is delivered to the conduit opening 25 through the gas delivery conduit 23.

In the region of the mixing tube 31, the mixing conduit 33 has at least two and in the first exemplary embodiment shown in FIGS. 1–4 has four cross-sectional constrictions 37, disposed in the form of oblong sections in succession in the direction of fuel-gas mixture flow; they each constrict the cross section of the mixing conduit 33 in a limited region, and adjoining them in the flow direction, the cross section of the mixing conduit 33 widens again. The cross-sectional constrictions 37 are produced for instance by pinching the wall of the mixing tube 31; this produces a somewhat wavy longitudinal profile in the flow direction, as FIGS. 1–4 also show. However, it is also possible to form the cross-sectional constrictions 37 by means of perforated screens, for instance, disposed in the mixing conduit 33 and each having one or more through openings.

A throttle restriction 41 that serves as a preliminary throttle for the fuel-gas mixture is provided on a second end 39 of the mixing conduit 33, remote from the first conduit end 35, in the mixing tube 31 downstream of the cross-sectional constrictions 37. By way of example, the throttle restriction 41 is embodied as a perforated screen 43, with a narrow throttle opening 45 or a plurality of throttle openings.

In the mixture flow direction downstream of the throttle restriction 41, the mixing tube 31 has a nozzle end closure 47 that arches outward in the flow direction and defines the mixing conduit 33 on its second end 39. At least one, and in the first exemplary embodiment, two nozzle openings 49 are provided in the nozzle end closure 47. The nozzle openings 49 are inclined obliquely outward relative to the longitudinal valve axis 3 in the mixture flow direction.

Figure 2:
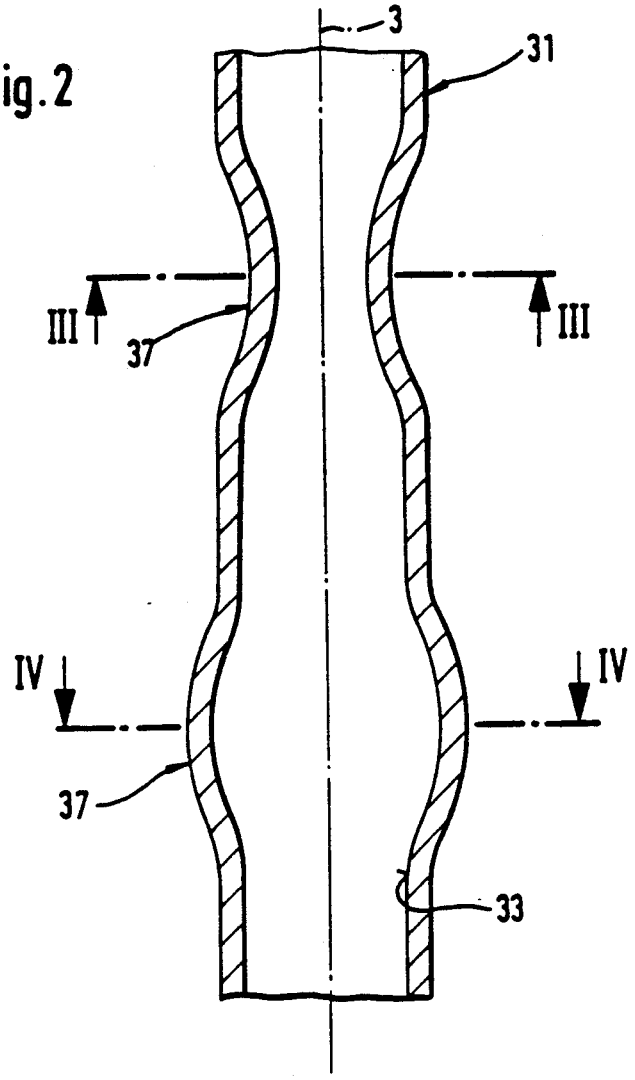
FIG. 2 is a fragmentary view of the mixing conduit in a first exemplary embodiment.
Figure 3:
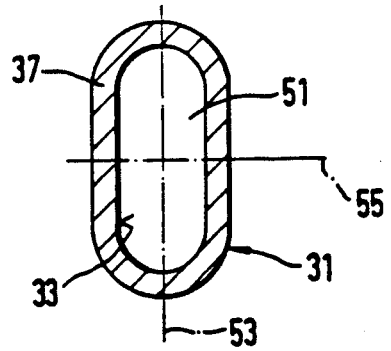
FIG. 3 is a section taken along the line III—III of FIG. 2.
Figure 4:
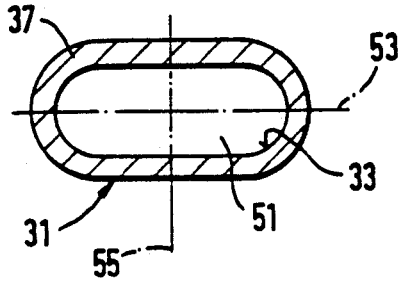
FIG. 4 is a section taken along the line IV—IV of FIG. 2.

As can be seen in FIGS. 2–4, which show the mixing tube 31 of the first exemplary embodiment shown in fragmentary form, the cross-sectional constrictions 37 formed by pinching of the wall of the mixing tube 31 each have one elongated free opening cross section 51 in the direction at right angles to the longitudinal valve axis 3 and thus at right angles to the flow direction of the fuel-gas mixture; the free opening cross sections 51 of the various cross-sectional constrictions 37 extend parallel to one another. In the direction of their greatest length, the free opening cross sections 51 of the cross-sectional constrictions 37 each have one longitudinal axis 53 and for example at right angles to it in the direction of their shortest length they each have one transverse axis 55. Each two adjacent cross-sectional constrictions 37 are embodied such that the longitudinal axes 53 of the free opening cross sections 51 of the two cross-sectional constrictions 37 extend at right angles to one another.

As a result of this embodiment of the mixing conduit 33, the fuel film forming on the wall of the mixing conduit and running along it is torn away from the wall by the increased speed of the gas or of the fuel-gas mixture in the cross-sectional constrictions 37 and breaks down into fine fuel droplets. In this way, the quality of fuel atomization is substantially improved, or if the atomization quantity is unchanged, then the gas quantity delivered can be reduced substantially. The throttle restriction 41 formed on the second end 39 of the mixing conduit 33 remote from the fuel injection valve 1 and acting as a preliminary throttle causes the fuel film deposited on the wall of the mixing conduit 33 to tear off and be preatomized, so that the proportion of fuel in the fuel-gas mixture flowing through the mixing conduit 33 is increased. The nozzle openings 49, for instance two in number, of the arched nozzle cap 47 enable not only a single-stream characteristic but also a double-stream characteristic, for example, of the fuel-gas mixture injected through the mixing tube of the apparatus of the invention.

Figure 5:
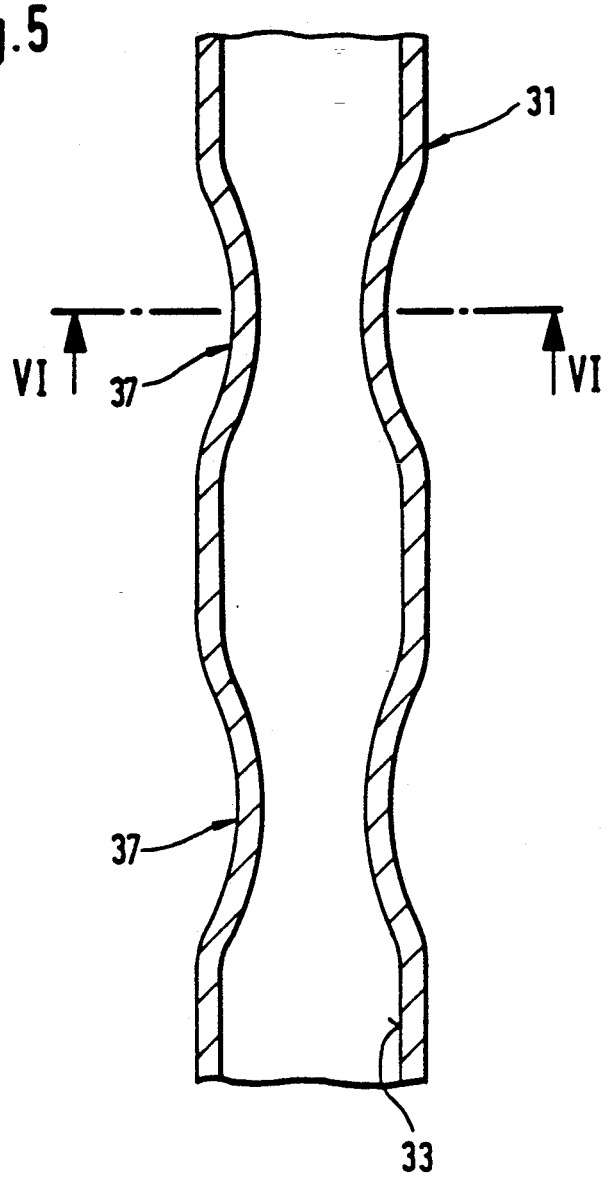
FIG. 5 is a fragmentary view of a mixing conduit in a second exemplary embodiment.
Figure 6:
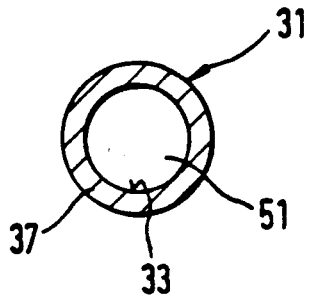
FIG. 6 is a section taken along the line VI—VI of FIG. 5.

A mixing tube 31 of an apparatus for injecting a fuel-gas mixture according to a second exemplary embodiment of the invention is shown in fragmentary form in FIGS. 5 and 6; FIG. 6 is a section along the line VI—VI of FIG. 5. Elements that are the same and function the same are identified by the same reference numerals as in FIGS. 1–4. The second exemplary embodiment differs from the first exemplary embodiment shown in FIGS. 1–4 only in the form of the cross-sectional constrictions 37 of the mixing tube 31. The mixing tube 31 has at least two cross-sectional constrictions 37 of the mixing conduit 33, disposed one after another in the mixture flow direction; for example, they are formed by pinching of the wall of the mixing tube 31. The cross-sectional constrictions 37 have a single circular free opening cross section 51, for example, which widens again downstream of the associated cross-sectional constriction 37. Because of the increased speed of the gas or fuel-gas mixture in the region of the cross-sectional constrictions 37, the fuel deposited on the wall of the mixing conduit 33 is torn away from the wall and finely atomized.

Because of the cross-sectional constrictions 37 of the mixing conduit 33, the development of the fuel film on the wall of the mixing conduit 33 is reduced substantially, so that the formation of a maximally homogeneous fuel-gas mixture with fine atomization of the fuel is attained.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An apparatus for injecting a fuel-gas mixture, having a fuel injection valve which has at least one injection port on one end, a mixing conduit downstream of said at least one injection port, said mixing conduit includes a first end into which fuel is injected through the at least one injection port of the fuel injection valve, a gas delivery conduit that communicates with the first end of said mixing conduit for injecting a gas directly into said mixing conduit downstream and spaced from said at least one port, which gas strikes the fuel admitted to said mixing conduit for mixing therewith, said mixing conduit (33), includes at least one cross-sectional constriction (37) downstream of said first end of said mixing conduit, and an adjoining section in a flow direction in which the cross section of the mixing conduit (33) widens.

2. An apparatus as defined by claim 1, in which at least two adjacent cross-sectional constrictions (37) have elongated free opening cross sections (51).

3. An apparatus as defined by claim 2, in which the cross-sectional constrictions (37) each have one longitudinal axis (53), extending in a direction of greatest length of the free opening cross section (51), and that the longitudinal axes (53) of the free opening cross sections (51) of said at least two adjacent cross-sectional constrictions (37) extend at right angles to one another.

4. An apparatus as defined by claim 1, in which the at least one cross-sectional constriction (37) of the mixing conduit (33) is formed by a pinching of the wall of the mixing conduit (33).

5. An apparatus as set forth in claim 4 in which said at least one constriction is oval in shape.

6. An apparatus as set forth in claim 4 in which said at least one constriction is circular in shape.

7. An apparatus as defined by claim 1, in which a throttle restriction (41) is provided in a second end (39) of the mixing conduit (33) remote from the first conduit end (35).

8. An apparatus as defined by claim 7, in which a nozzle end closure (47), provided on a second end (39) of the mixing conduit (33), has at least one nozzle opening (43).

9. An apparatus as defined by claim 8, in which the nozzle end closure (47) is arched outward in a flow direction of the fuel-gas mixture.

10. An apparatus as defined by claim 1, in which a nozzle end closure (47), provided on a second end (39) of the mixing conduit (33) has at least one nozzle opening (43).

11. An apparatus as defined by claim 10, in which the nozzle end closure (47) is arched outward in a flow direction of the fuel-gas mixture.

* * * * *